US006693410B1

(12) United States Patent
Terrien

(10) Patent No.: US 6,693,410 B1
(45) Date of Patent: Feb. 17, 2004

(54) POWER SEQUENCING AND RAMP RATE CONTROL CIRCUIT

(75) Inventor: Dale M. Terrien, Yorba Linda, CA (US)

(73) Assignee: ADC DSL Systems, Inc., Eden Prairie, MN (US)

( * ) Notice: Subject to any disclaimer, the term of this patent is extended or adjusted under 35 U.S.C. 154(b) by 0 days.

(21) Appl. No.: 10/320,042

(22) Filed: Dec. 16, 2002

(51) Int. Cl.[7] ..... G05F 1/40; G05F 1/44
(52) U.S. Cl. ..... 323/274; 323/273; 323/284
(58) Field of Search ..... 323/272, 273, 323/274, 282, 284

(56) References Cited

U.S. PATENT DOCUMENTS 5,686,820 A * 11/1997 Riggio, Jr. ..... 323/273
6,184,669 B1 * 2/2001 Matsuo ..... 323/303
6,377,033 B2 * 4/2002 Hsu ..... 323/274
6,472,854 B2 * 10/2002 Ootani ..... 323/272

* cited by examiner

*Primary Examiner*—Bao Q. Vu
(74) *Attorney, Agent, or Firm*—Fogg and Associates, LLC; Scott V. Lundberg

(57) ABSTRACT

Power control circuits that control the power sequencing and ramp rate of voltages applied to integrated circuits are disclosed. In one embodiment, a power control circuit comprises a delay resistor, a delay capacitor and an input transistor. The delay resistor is adapted to be coupled to an input power supply. The delay capacitor is coupled in series with the delay resistor. The input transistor has an emitter that is adapted to be coupled to the input power supply through the delay resister. The input transistor conducts current when a voltage across the delay capacitor rises above a selected voltage threshold of the input transistor. A power source is applied to a load in response to the conduction of the input transistor which is delayed by the time it takes to charge the delay capacitor to the selected voltage threshold.

29 Claims, 5 Drawing Sheets

POWER SEQUENCING AND RAMP RATE CONTROL CIRCUIT

TECHNICAL FIELD

The present invention relates generally to controlling voltages on power up and in particular the present invention relates to controlling the power sequencing and ramp rate of voltages applied to integrated circuits.

BACKGROUND

With the ongoing decrease in feature size used to design integrated circuits (ICs), it has become common for ICs to require multiple power supplies. For example, a common I/O voltage for digital ICs is either +3.3V or +5V and a common core voltage is in the range of 1.5V to 3.3V. Typically, an IC manufacture requires specific characteristics from the power supplies. Such characteristics include the order in which the power supplies are applied (power sequencing) and the ramp rate of the voltages (i.e. the rate of time in which a power supply ramps up from zero volts to its specified voltage).

Power sequencing is usually accomplished with the use of time delay circuits that control pass devices such as power field effect transistors (FETs) which operate as a switch. For example, a typical time delay circuit includes a current source, a capacitor and the pass device. The current source is adapted to charge a capacitor. When the voltage across the capacitor rises above some fixed reference threshold, the circuit is adapted to turn on the pass device. A desired requirement for a power sequencing application is that the circuit operates reliably from an input voltage of zero volts up to the normal voltage of the power supply. Unfortunately, with the typical implementation of power sequencing circuits utilizing the time delay circuits as described above, both a fixed reference (usually a band-gap device) and a comparator of the power sequencing circuit require a minimum non-zero voltage applied to their power inputs to operate properly. As a result, the typical power sequencing circuit of the prior art as described above is difficult to operate reliably from an input voltage of zero volts (V) to the normal voltage of the power supply. Another common power sequencing application has a similar limitation. In this method time delays are created with the use of an oscillator of a known frequency and a counter adapted to count a given number of clock cycles. However, in this type of power sequencing application, the typical oscillator requires even a higher voltage on its power input before it is operational which makes it impractical for very short delays. What is desired in the art is a power sequencing application that operates reliably all the way down to zero volts and a power sequencing application that is also configured to create very short delays times.

One known method of controlling the ramp rate is by indirectly utilizing a slow-start circuit on the controller of a DC-DC or AC-DC power converter. However, the slow-start circuits are intended to reduce input surge current on power up and are typically not designed to meet the power-up requirements of a specific load. This is typically because the power converters are purchased as modules from a vendor and the circuit designer has little input into the design of the module. In this situation, the best that can be achieved is to select a module which has an output voltage ramp rate that meets the requirements of the integrated circuits used. What is desired in the art is a ramp rate circuit adapted to effectively handle a defined power source. The situation is further complicated when multiple circuits on a circuit board require different (possibly conflicting) power sequencing and voltage ramp rates. In this case, it is impossible to select a module which will meet all of the requirements and additional circuitry required. Accordingly, it is further desired in the art to have a simple circuit to control time delay and ramp control rate.

SUMMARY

The above-mentioned problems and other problems of the prior art are overcome by the present invention and will be understood by reading and studying the following specification.

In one embodiment, a power control circuit is disclosed. The power control circuit comprises a delay resistor, a delay capacitor and an input transistor. The delay resistor is adapted to be coupled to an input power supply. The delay capacitor is coupled in series with the delay resistor. The input transistor has an emitter that is adapted to be coupled to the input power supply through the delay resister. The input transistor conducts current when a voltage across the delay capacitor rises above a selected voltage threshold of the input transistor. A power source is applied to a load in response to the conduction of the input transistor which is delayed by the time it takes to charge the delay capacitor to the selected voltage threshold.

In further another embodiment, another power control circuit is disclosed. This power control circuit includes first and second nodes, a delay resistor, a delay capacitor, an input transistor, an amplifying transistor, a pass device and first and second feedback resistors. The first node is adapted to be coupled to a I/O power supply. The second node is adapted to be coupled to a core power supply. The delay resister is coupled between the delay capacitor and the first node. The input transistor has an emitter that is coupled to the first node through the delay resistor. The amplifying transistor has a base coupled to the collector of the input transistor. The pass device has an activation input that is coupled to a collector of the amplifying transistor. The pass device further has a power input that is coupled to the second node and output adapted to be coupled to a load. The pass device passes the core power supply coupled to the second node to the load when the activation input of the pass device receives a current from the collector of the amplifying transistor. The first feedback resistor is coupled between the output of the load to a base of the input transistor. The second feedback resistor is coupled between the base of the input transistor and a ground.

In another embodiment, a method of operating a power control circuit to regulate the coupling of a power source to a load is disclosed. The method comprises coupling the power source to an emitter of an input transistor through a delay resistor. Coupling the power source to a delay capacitor through the delay resistor. Charging the delay capacitor. When the charge on the delay capacitor exceeds a base-emitter threshold voltage of the input transistor, producing an activation current with the input transistor and then passing the power source to the load in response to activation current.

In yet another embodiment, a method of operating a power control circuit is disclosed. The method comprises coupling a first power source at a first node. Coupling a second power source at a second node. Coupling the first power source to an emitter of an input transistor through a delay resistor. Charging a delay capacitor coupled to the first power source through the delay resistor. Activating the input transistor when the charge on the delay capacitor exceeds an emitter-base voltage threshold of the input transistor and passing the second power source to a load in response to the activation of the input transistor.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description of the preferred embodiments, reference is made to the accompanying drawings, which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Figure 1:
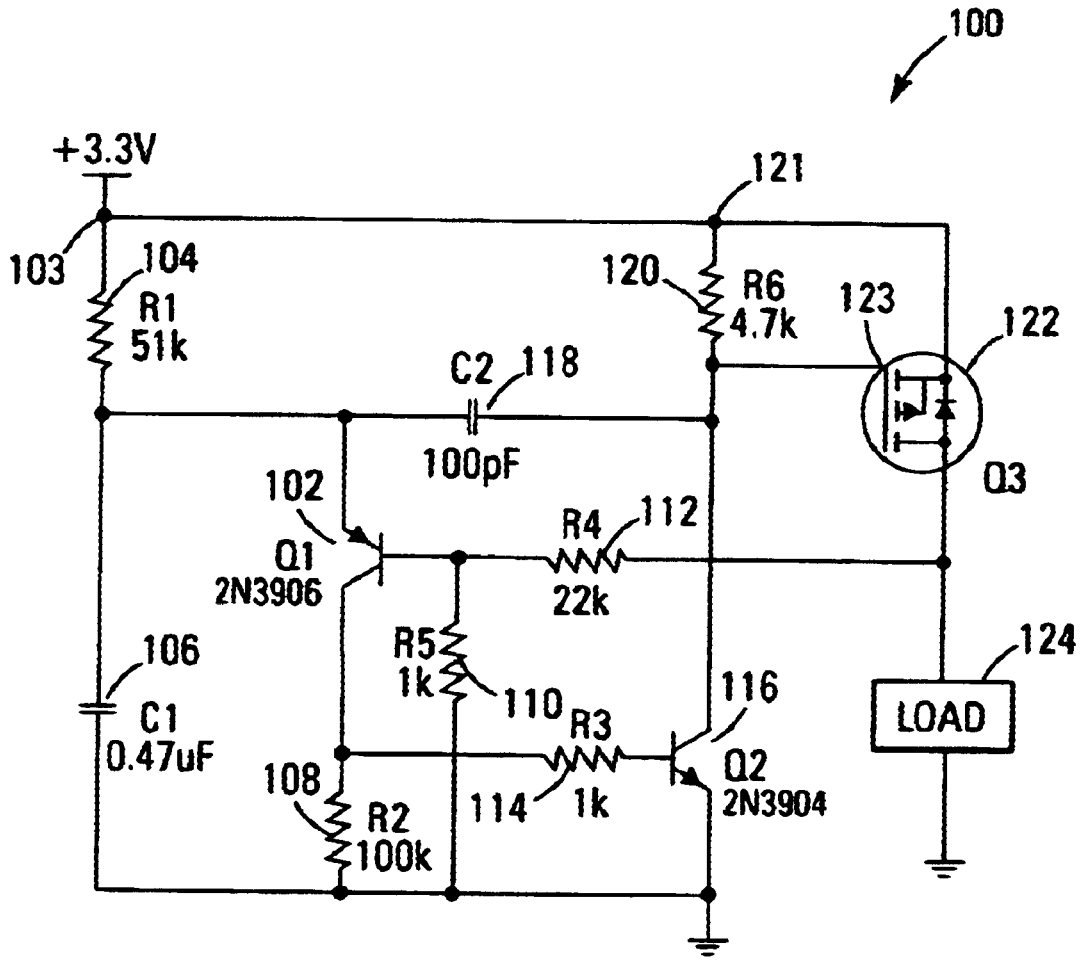
FIG. 1 is a schematic diagram of one embodiment of the present invention.

Embodiments of the present invention include simple circuits that control time delay and ramp rate. Referring to FIG. 1, one embodiment of a power sequencing and ramp control circuit 100 (control circuit 100) of the present invention is illustrated. The embodiment of FIG. 1 is illustrated as being adapted to receive one power supply (which is 3.3 V in this example) at input node 103. This embodiment can be used when there is a known relationship between this power supply and another power supply but this power supply (the 3.3 V) needs to be delayed slightly before being applied to the circuit. This embodiment can also be used where a converter module (that provides power) has a ramp rate which is too slow for a given load 124. In this example, the control circuit 100 is used to wait until the converter's output has reached its full value (3.3 V) and then provide a fast voltage ramp rate to the load 124.

Figure 3:
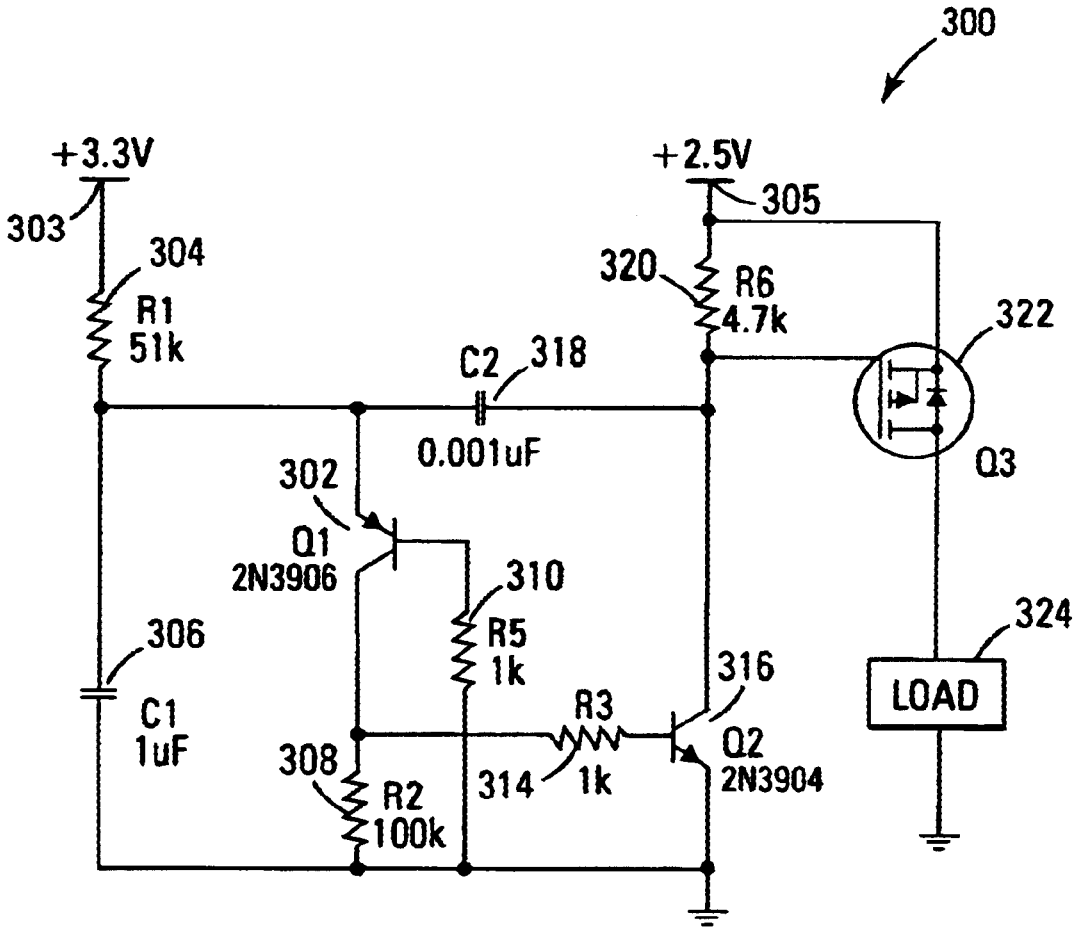
FIG. 3 is a schematic diagram of yet another embodiment of the present invention.

As illustrated in FIG. 1, the control circuit 100 includes PNP input transistor 102. Feedback from an output of a pass device 122 is applied to the base of input transistor 102 through divider (or feedback) resistors 112 and 110. The collector output of input transistor 102 is coupled through resistors 108 and 114 to an inverting amplifier stage which comprises amplifying transistor 116 coupled in a common emitter configuration. This configuration of amplifying transistor 116 provides additional gain. Resister 120 provides a load for amplifying transistor 116 and ensures that the pass device 122 remains off when transistor 116 is not conducting. Capacitor 118 provides loop compensation to ensure that the amplifier maintains stability. In some embodiments of the present invention, capacitor 118 is not included in the control circuit 100 as the values of other components in the control circuit ensure stability without capacitor 118. An example of one such embodiment is when there is little or no feedback provided from the output of the pass device 122 to the base of input transistor 102 (high ratio of feedback resistors 112 and 110 (R4/R5)). In a relatively extreme situation of no feedback (as illustrated in FIG. 3), there is no need for loop compensation, even though capacitor 318 has been included in the circuit. Another example of an embodiment in which capacitor 118 could be eliminated is where the gain of the amplifier is reduced through one or more of the following modifications: using a lower gain device for transistor 116 or transistor 102, reducing the value of resistor 108, adding an emitter resistor to transistor 116 (emitter degeneration), or adding a capacitor from the base to the collector of transistor 116 (local compensation).

Figure 2:
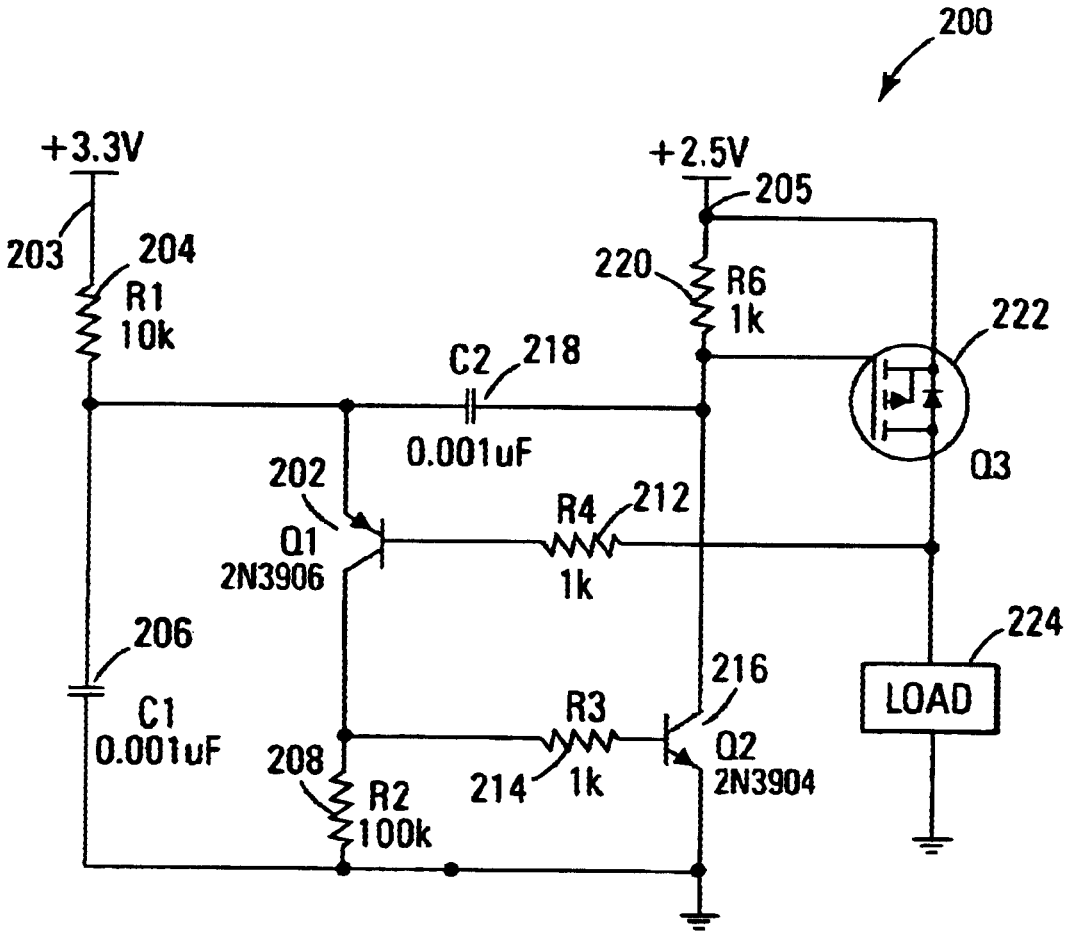
FIG. 2 is a schematic diagram of another embodiment of the present invention.

The values of delay resistor 104 and delay capacitor 106 determine the time delay of the control circuit 100. Moreover, the values of feedback resistors 112 and 110 determine the ramp rate of the control circuit 100. Accordingly, their values can be selected to obtain a desired result. There is some interaction between the components (i.e. the delay resistor 104, delay capacitor 106 and feedback resistors 112 and 110) that make the time delay and ramp rate, as the ramp rate is also affected by the selection of delay resistor 104 and delay capacitor 106. The design process is to first select the delay time through delay resistor 104 and delay capacitor 106 and then adjust the ramp rate with the ratio of feedback resistors 112 and 110. Because of this interaction, in some embodiments of the present invention that are adapted to handle relatively extreme situations at least one of the feedback resistors is not required. Examples of embodiments of these types are illustrated in FIGS. 2 and 3.

Referring back to FIG. 1, control circuit 100, operates as follows: When the power source (the 3.3V input voltage this example) is initially applied to node 103, the power at transistors 102 and 116 and the pass device 122 are all off. Moreover, initially when the input voltage to input node 103 or the control circuit rises, both transistors 102 and 116 remain off and resistor 120 maintains the pass device 122 off. During this time, delay capacitor 106 begins charging though delay resistor 104. When the voltage across delay capacitor 106 rises above a base-emitter voltage threshold of the input transistor 102 (which in this example is 0.6V), input transistor 102 begins to conduct current. This turns on amplifying transistor 116 which in turn, turns on pass device 122. In particular, in response to the current from transistor 102, transistor 116 is activated which allows current to flow through resister 120 to ground. This causes the voltage at node 123 (or activation input 123) to drop thereby turning on pass device 122. Accordingly, the initial delay of the control circuit 100 is determined by the amount of time it takes for delay capacitor 106 to charge up to the base-emitter voltage threshold of input transistor 102. Once the circuit begins conducting, the overall gain of the control circuit 100 (selected by the ratio of feedback resistors 112 (R4) and 110 (R5)) will determine the ramp rate. If the ratio of R4/R5 is high, there is very little feedback and the gain is high resulting in the output voltage of the control circuit 100 rising very quickly after input transistor 102 begins conducting. If the ratio of R4/R5 is low, there is a lot of feedback and the gain is low resulting in the output voltage of the control circuit 100 trying to follow the slow charge rate of delay capacitor 106 after input transistor 102 begins conducting.

The control circuit of FIG. 1 is similar to a two stage amplifier except in its first stage, the power source is applied to the emitter. This enables control circuit 100 to operate through zero volts which has significant advantages over existing systems. As indicated above the size of the delay resistor 102, the delay capacitor 104, and the feedback resisters 112 and 110 are selected to achieve a desired result. In addition, the ramp rate can be further adjusted by varying the bandwidth of the transistors 102 and 116. For example a transistor with a higher bandwidth will produce a faster ramp rate.

In addition, FIG. 1 illustrates an embodiment that is adapted to be coupled to one power source (i.e. 3.3V) at node 103, since in this circuit, the same voltage is applied to both node 103 and node 121. In other embodiments in which different power levels are required, separate power supplies are applied to nodes 103 and 121. This feature is illustrated in the embodiments of FIGS. 2 and 3. Moreover, in some embodiments of the present invention the pass device 122 includes a field effect transistor (FET). Further still in other embodiments, the pass device 122 includes a bipolar transistor. The use of a bipolar transistor over a FET in the pass device 122 provides faster ramp rates, however an additional voltage drop may be result.

FIG. 2, illustrates another embodiment of a control circuit 200 of the present invention. In this embodiment, one voltage supply (in this example, 3.3V I/O voltage) is used to control another voltage supply (in this example, 2.5 V core voltage). That is, the I/O voltage supply is used to activate input transistor 202 which causes pass device 222 to be turned on and pass the core voltage supply to the load 124. As illustrated, the 3.3V power supply is applied to node 203 and the 2.5V power supply is applied to node 205. Control circuit 200 includes amplifying transistor 216, delay resistor 204, delay capacitor 206 and feedback resistor 212 (R4). Further shown are pass circuit 222, load 224 capacitor 218 and resistors 208, 220 and 214.

As stated above, the control circuit 200 of FIG. 2 illustrates an embodiment that operates with two different input power supplies. In this relatively extreme example, a second feedback resistor (similar to feedback resistor 110 (R5) of FIG. 1) is not used. With the delay resistor 204 and the delay capacitor 206 having relatively small values (10K and 0.001 uF respectfully in this example) and with R5 removed, the circuit acts as a voltage follower, guaranteeing that the voltage applied to the load from the 2.5V power supply never rises above the 3.3V power supply regardless of how slowly the 3.3V power supply ramps up. In particular, if the output voltage tries to rise higher than one base-emitter drop below the voltage across delay capacitor 206, the conduction of input transistor 202 will decrease, which in turn will reduce conduction of input transistor 202 and pass circuit 222. In essence, the base-emitter junction of input transistor 202 serves as a comparator between the voltage across delay capacitor 206 and the output voltage in this embodiment. This embodiment is useful in situations where the load 224 requires the 3.3V power supply voltage (I/O voltage) to come up before the 2.5V power supply (core voltage) even though the power supply module used actually supplies the 2.5V before the 3.3V or the 2.5V power supply has a faster ramp rate than the 3.3V power supply.

Referring to FIG. 3, yet another embodiment of an extreme example of a control circuit 300 of the present invention is illustrated. Here again in this embodiment, one power supply (the 3.3V in this example) is used to control the other power supply (2.5V in this example). That is, the 3.3V supply is used to activate input transistor 302 which causes pass device 322 to be turned on and pass the 2.5V supply to the load 324. As illustrated in FIG. 3, this embodiment includes, input transistor 302 and amplifying transistor 316. Control circuit 300 further includes delay resistor 304, delay capacitor 306 and feedback resistor 310 (R5). Moreover as illustrated, control circuit 300 further yet includes pass circuit 322, load 324, capacitor 318 and resistors 320, 314 and 308.

In the embodiment of FIG. 3, both the delay resistor 304 and delay capacitor 306 have relatively large values (51K and 1 uF respectfully in this example). This provides a long delay between the 3.3V power supply and the 2.5V power supply being applied to the load. Moreover, in this embodiment the first feed back resister (similar to the feedback resister 112 (R4) of FIG. 1) is removed. With R4 being removed, the pass circuit 322 will be turned on quickly after the input transistor 302 begins conducting which provides a fast ramp rate. The embodiment of FIG. 3 is useful in situations where power must not be applied to the load before some other device has completed its initialization or to provide time for a clock source to stabilize before the load is powered up. In essence, control circuit 300 of FIG. 3 operates with no feedback from the output (can also be referred to as "open loop"). In this mode, it operates as a high gain comparator (or switch) with a threshold determined by the base-emitter junction of input transistor 302. With resistor 310 connected to ground, the base current of input transistor 302 increases rapidly after delay capacitor 306 charges above the threshold voltage (the base current continues to increase as the voltage across the delay capacitor increases), which in turn causes the input transistor to conduct more current.

Figure 4:
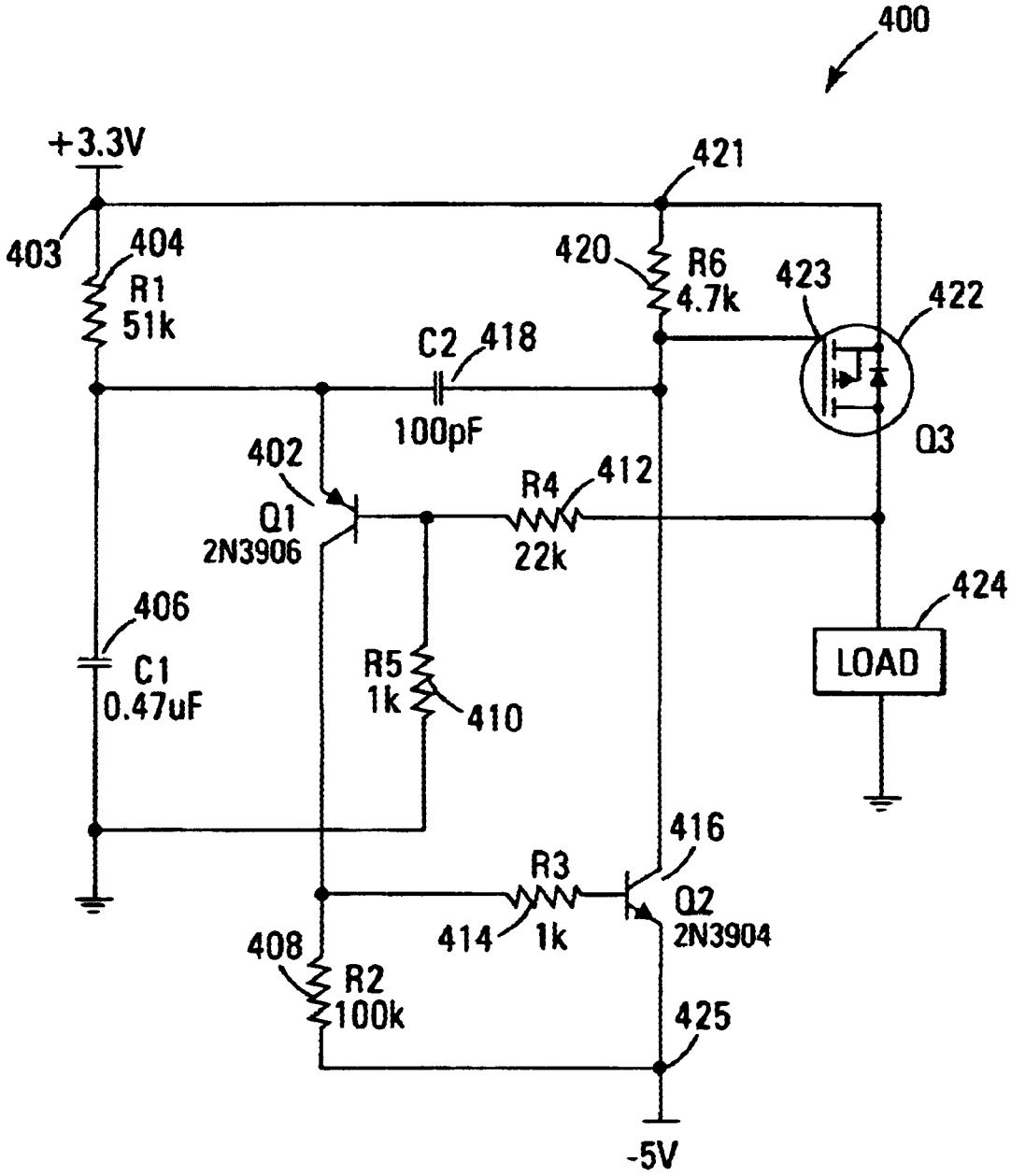
FIG. 4 is a schematic diagram of further yet another embodiment of the present invention.

Yet another embodiment of a control circuit 400 of the present invention is illustrated in FIG. 4. Control circuit 400 is used in situations where the core voltage is too low to allow adequate drive for the pass device 422. As illustrated, the embodiment of FIG. 4 includes a first node 303 adapted to receive an I/O voltage (which in this embodiment is 3.3V) and a second node 421 which is also adapted to receive the I/O voltage. The delay capacitor 406 is charged with the I/O voltage through the delay resistor 404. The I/O voltage is coupled to the emitter of input transistor 402 also through resistor 404. Once the charge on the delay capacitor 406 exceeds a selected threshold value, which in this case is the base-emitter voltage threshold of the input transistor 402, the input transmitter 402 begins to conduct current. This current is coupled to the base of amplifying transistor 416 through resistor 414. This current activates amplifying transistor 416. In response to the activation of transistor 416, current flows through resister 420 to node 425 which is coupled to a negative voltage rail (−5V in this example). The use of the negative voltage rail ensures the voltage drop at node 423 is adequate enough to turn on pass device 422 when the amplifying transistor 416 is activated. An output of the pass device is coupled to the load 424. Also illustrated in the control circuit 400 of FIG. 4, are feedback resistors 412 and 410, capacitor 418 and resistor 408 which all have similar functions as described above with regard to similar elements in the other embodiments of the present invention.

Figure 5:
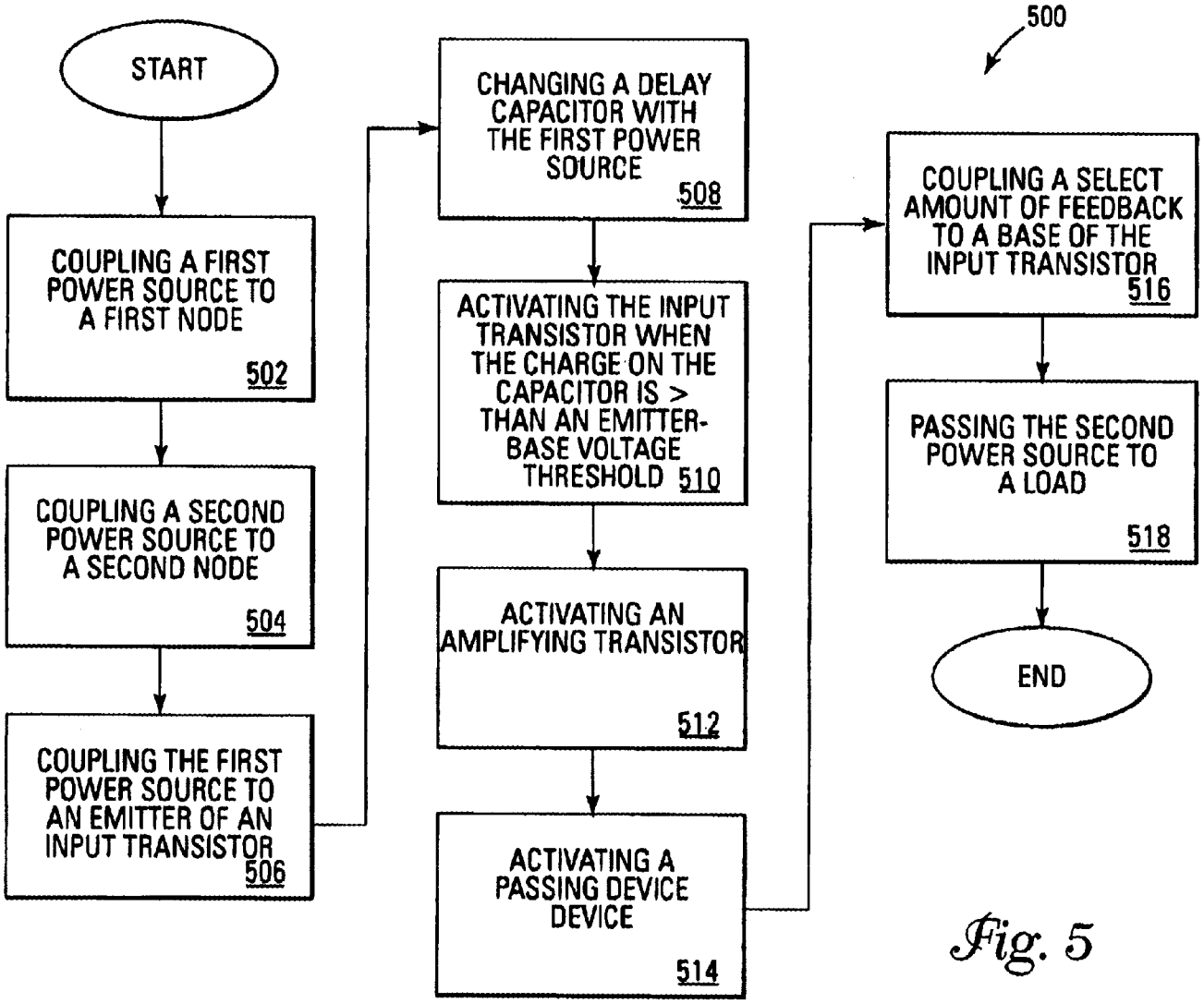
FIG. 5 is a flowchart illustrating one embodiment of one method of operating a power control circuit of the present invention.

Referring to FIG. 5, one embodiment of a method of applying the present invention is illustrated in flow chart 500. As indicated in flow chart 500, the control circuit starts by coupling a first power source to a first node (502) and a second power source to a second node (504). As discussed above, in some applications, the second power source may be the same as the first power source. The first power source is then coupled to an emitter of an input transistor through a delay resister (506). The first power source is also coupled to a delay capacitor through the delay resister (506). The delay capacitor is then charged with the first power source (508). The input transistor is activated when the charge on the delay capacitor exceeds an emitter-base voltage threshold of the input transistor (510). This controls the delay rate. An amplifying transistor is activated in response to the activation of the input transistor (512). A Pass device is then activated in response to the activation of the amplifying transistor (514). A select amount of feedback is then applied to the base of the input transistor (516). This controls the ramp rate of the second power source when it is applied to a load. The second power source is then passed on to the load (518).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Moreover, the values of the components provided in this application are merely examples and are only representative and not limiting (i.e. other voltages, resistances etc. are used in other embodiments). Therefore, it is manifestly intended that this invention be limited only by the claims and the equivalents thereof.

What is claimed is:

1. A power control circuit comprising:

a delay resistor adapted to be coupled to an input power supply;

a delay capacitor coupled in series with the delay resistor; and an input transistor having an emitter adapted to be coupled to the input power supply through the delay resister, wherein the input transistor conducts current when a voltage across the delay capacitor rises above a selected voltage threshold of the input transistor, further wherein a power source is applied to a load in response to the conduction of the input transistor which is delayed by the time it takes to charge the delay capacitor to the selected voltage threshold.

2. The power control circuit of claim 1, further comprising:

at least one feedback resistor coupled to a base of the input transistor to provide feedback, wherein the amount of feedback applied to the base of the input transistor contributes to the ramp rate in which the power source is applied to the load.

3. The power control circuit of claim 1, wherein the selected voltage threshold is a base-emitter voltage threshold of the input transistor.

4. The power control circuit of claim 1, wherein the power source is the input power supply.

5. The power control circuit of claim 1, further comprising:

an amplifying transistor coupled to conduct current in response to the input transistor conducting; and a pass device coupled between the power source and the load, the pass device is adapted to turn on when the amplifying transistor conducts current.

6. The power control circuit of claim 5, wherein the pass device further comprises:

a field effect transistor.

7. The power control circuit of claim 5, wherein the pass device further comprises:

a bipolar transistor.

8. The power control circuit of claim 5, wherein an emitter of the amplifying transistor is coupled to a negative voltage rail.

9. The power control circuit of claim 5, further comprising:

at least one feedback resistor coupled to a base of the input transistor to provide feedback, wherein the amount of feedback applied to the base of the input transistor contributes to the ramp rate in which the power source is applied to the load.

10. The power control circuit of claim 9, wherein the at least one feedback resistor further comprises:

a first feedback resistor coupled between an output of the pass device and the base of the input transistor; and a second feedback resistor coupled between a ground and the base of the input transistor.

11. The power control circuit of claim 9, where the at least one feedback resister comprises:

a first feedback resistor coupled between an output of the pass device and the base of the input transistor.

12. The power control circuit of claim 9, wherein the at least one feedback resister comprises:

a second feedback resistor coupled between a ground and the base of the input transistor.

13. A power control circuit comprising:

a first node adapted to be coupled to a I/O power supply;

a second node adapted to be coupled to a core power supply;

a delay resister;

a delay capacitor, the delay resister coupled between the delay capacitor and the first node;

an input transistor having an emitter coupled to the first node through the delay resistor;

an amplifying transistor having a base coupled to the collector of the input transistor;

a pass device having an activation input coupled to a collector of the amplifying transistor, the pass device further having a power input coupled to the second node and output adapted to be coupled to a load, wherein the pass device passes the core power supply coupled to the second node to the load when the amplifying transistor conducts current; and at least one feedback resistor coupled to provide feedback to a base of the input transistor.

14. The power control circuit of claim 13, wherein the at least one feedback resistor comprises:

a first feedback resistor coupled between the output of the load to a base of the input transistor; and a second feedback resistor coupled between the base of the input transistor and a ground.

15. The power control circuit of claim 13, further comprising:

a first resistor coupled between the collector of the input transistor and the delay capacitor, the first resister further coupled between ground and the collector of the input transistor.

16. The power control circuit of claim 13, further comprising a first capacitor coupled between the emitter of the input transistor and the activation input of the pass device.

17. The power control circuit of claim 13, further comprising:

a second resistor coupled between the second node and the activation input of the pass device.

18. The power control circuit of claim 13, further comprising:

a third resistor coupled between the collector of the input transistor and the base of the amplifying transistor.

19. The power control circuit of claim 13, wherein the pass device further comprises:

a field effect transistor.

20. The power control circuit of claim 13, wherein the pass device further comprises:

a bipolar transistor.

21. A method of operating a power control circuit to regulate the coupling of a power source to a load, the method comprising:

coupling the power source to an emitter of an input transistor through a delay resistor;

coupling the power source to a delay capacitor through the delay resistor;

charging the delay capacitor;

when the charge on the delay capacitor exceeds a base-emitter threshold voltage of the input transistor, producing an activation current with the input transistor; and passing the power source to the load in response to activation current.

22. The method of claim 21, wherein passing the power source to the load further comprises:

activating an amplifying transistor with the activation current; and activating a pass device in response to the activation of the amplifying transmitter.

23. The method of claim 21, further comprising:

controlling the ramp rate of the power supply to the load.

24. The method of claim 23, wherein controlling the ramp rate of the power supply to the load further comprises:

coupling a select amount of feedback to a base of the input transistor.

25. A method of operating a power control circuit, the method comprising:

coupling a first power source at a first node;

coupling a second power source at a second node;

coupling the first power source to an emitter of an input transistor through a delay resistor;

charging a delay capacitor coupled to the first power source through the delay resistor;

activating the input transistor when the charge on the delay capacitor exceeds an emitter-base voltage threshold of the input transistor; and passing the second power source to a load in response to the activation of the input transistor.

26. The method of claim 25, comprising:

coupling a select amount of feedback to a base of the input transistor to control the ramp rate in which the second power source is applied to the load.

27. The method of claim 25, wherein the first and second power source are the same.

28. The method of claim 25, wherein passing the second power source to the load further comprises:

activating an amplifying transistor in response to the activation of the input transistor; and activating a passing device in response to the activation of the amplifying transistor.

29. The method of claim 28, wherein the amplifying transistor provides additional gain.

* * * * *